US006418897B1

(12) United States Patent
Urban et al.

(10) Patent No.: US 6,418,897 B1
(45) Date of Patent: Jul. 16, 2002

(54) DEVICE FOR ADJUSTING THE ANGLE OF ROTATION OF A CAMSHAFT

(75) Inventors: Peter Urban, Ruppichterroth; Andreas Strauss, Forchheim; Dieter Goppelt, Aurachtal, all of (DE)

(73) Assignee: Ina Walzlager Schaeffler oHG (DE)

( * ) Notice: Subject to any disclaimer, the term of this patent is extended or adjusted under 35 U.S.C. 154(b) by 0 days.

(21) Appl. No.: 09/913,907

(22) PCT Filed: Feb. 9, 2000

(86) PCT No.: PCT/EP00/01017

§ 371 (c)(1),
(2), (4) Date: Aug. 17, 2001

(87) PCT Pub. No.: WO00/52308

PCT Pub. Date: Sep. 8, 2000

(30) Foreign Application Priority Data

Mar. 2, 1999 (DE) ..... 199 08 934

(51) Int. Cl.[7] ..... F01L 1/344
(52) U.S. Cl. ..... 123/90.17; 123/90.37
(58) Field of Search ..... 123/90.15, 90.17, 123/90.31, 90.33, 90.37; 74/568 R; 464/1, 2, 160

(56) References Cited

U.S. PATENT DOCUMENTS 5,666,914 A 9/1997 Ushida et al. ..... 123/90.17
5,836,277 A * 11/1998 Kira et al. ..... 123/90.17
5,865,151 A 2/1999 Fukaya et al. ..... 123/90.17
6,035,818 A * 3/2000 Sato et al. ..... 123/90.17
6,089,198 A * 7/2000 Goppelt et al. ..... 123/90.17

FOREIGN PATENT DOCUMENTS

| | | |
|---|---|---|
| DE | 4417959 | 11/1995 |
| EP | 0799976 | 10/1997 |
| EP | 0848141 | 6/1998 |
| EP | 0859130 | 8/1998 |

* cited by examiner

*Primary Examiner*—Weilun Lo
(74) *Attorney, Agent, or Firm*—Bierman, Muserlian and Lucas

(57) ABSTRACT

The invention concerns a device for the angular adjustment of a camshaft relative to the crankshaft of an internal combustion engine, particularly a vane-type adjuster (1) comprising a stator (12) that is driven by the crankshaft preferably through a traction element and a drive pinion (11), and a vane rotor (18) that can be pressurized by pressure oil and is rotationally fixed to the camshaft while possessing a means, preferably an axially displaceable fixing pin (37) for effecting a releasable, rotational fixing of the vane rotor. The drawback of oil leakage in common vane-type adjusters is avoided by the fact that all components of the vane-type adjuster (1) that have contact with pressure oil are arranged in an oil-tight housing (2).

6 Claims, 1 Drawing Sheet

DEVICE FOR ADJUSTING THE ANGLE OF ROTATION OF A CAMSHAFT

DESCRIPTION

Field of the Invention

The invention concerns a device for the angular adjustment of a camshaft relative to the crankshaft of an internal combustion engine, particularly a vane-type adjuster comprising a stator that is driven by the crankshaft preferably through a traction element and a drive pinion, and a vane rotor that is rotationally fixed to the camshaft and possesses a means, preferably an axially displaceable fixing pin for effecting a releasable, rotational fixing of the vane rotor.

BACKGROUND OF THE INVENTION

A generic device of the pre-cited type is known from DE 196 23 818 A1. In this device, the stator is screwed to a front plate and a chain sprocket which together form a housing with hydraulic chambers in which a vane rotor with vanes sub-dividing the hydraulic chambers is arranged for pivoting. The individual chambers can be pressurized by pressure oil delivered through hydraulic ducts, so that the vane rotor can pivot within a defined angular range or be fixed in any desired intermediate position. If the oil pressure falls below a certain minimum value (at a standstill or starting of the engine, or at a low engine speed), a locking member that is mounted for axial displacement in one of the vanes of the vane rotor, is pushed by spring force into an opening of the front plate. This causes the vane rotor and the stator to be non-rotatably coupled to each other, so that the camshaft is then driven directly by the chain sprocket. In this way, rattling noises are prevented at low engine speeds and an optimal adjustment of the inlet camshaft for starting the engine is assured. With increasing engine speed and a concomitant rise of the oil pressure, the locking of the vane rotor is released so that the angular adjustment function becomes effective again.

A drawback of this device is its lack of oil-tightness so that the device is only suitable for oil-tight encapsulated drives with a chain or gearwheel. For toothed belt drives, that are interesting from the cost and noise point of view, the aforesaid drive does not come into question.

OBJECT OF THE INVENTION

The object of the invention is therefore to provide a device for the angular adjustment of a camshaft that is also suitable for a toothed belt drive and can be economically manufactured.

SUMMARY OF THE INVENTION

This invention achieves this object by the fact that all components of the vane-type adjuster that have contact with pressure oil are arranged in an oil-tight housing. These components include at least the stator and the vane rotor and a means for a releasable, rotational fixing. Due to the oil-tight design of the vane-type adjuster, this can be driven by a toothed belt.

The oil-tight housing can be made, for example, as a turned part or by investment casting, injection molding, sinter molding or forging. Particularly economically, it is made as a deep drawn part out of steel sheet. Deep drawing permits the use of an inexpensive base material that can be given the final shape by a simple shaping method and only a small amount of subsequent machining. Due to the fact that the oil-tight housing comprises a camshaft-proximate housing part and a camshaft-distal housing part having approximately the same depth of deformation, an economic fabrication of the housing is assured.

Advantageously, the housing parts have a flat bottom whose periphery merges into a cylindrical section which continues into an outwardly extending flange. The housing is rendered oil-tight by a sealing of the individual flange connections. It is also conceivable to omit the cylindrical section on one of the housing parts and let its flat bottom merge directly into the radial flange. It is further conceivable to make this flange continue into an outer cylindrical portion having the profile of the toothed belt pulley rolled into its outer peripheral surface. This measure would eliminate the need of a separate toothed belt pulley and its fixing means.

It has proved to be of advantage that the flanges and the drive pinion can be connected to one another by flange screws equally spaced around the periphery of the vane-type adjuster and that the flange screws are configured as fitting screws that can be screwed into threaded bores of the drive pinion. Due to the fact that the flange screws are situated outside the pressure oil region, they cannot cause any oil leakage problems. The configuration of the flange screws as fitting screws assures a reliable transmission of the camshaft torque irrespective of the magnitude of the surface pressure between the flanges.

According to a further advantageous feature of the invention, a flat, appropriately sized compensating washer is arranged between at least one of the flat bottoms and the stator, and the diameter of this washer, with clearance, corresponds to the inner diameter of the cylindrical section. Compensating washers are available in a variety of thicknesses and permit a compensation of manufacturing tolerances of the deep drawn housing parts and their deformation caused by the tightening of the flange screws. This permits the setting of the axial play between the flanges that is needed for producing the bracing between the inner components of the vane-type adjuster required for the transmission of the camshaft torque. The radial and axial play of the vane rotor required for the freedom of movement and sealing of the vane rotor is assured by an appropriate working of the vane rotor and the stator.

The transmission of the camshaft torque is achieved by the fact that the drive pinion, the flanges, the housing parts, the compensating washers and the stator can be braced rotationally fast to one another with the help of the flange screws. An advantage of this is that the biasing force of the flange screws acts, above all, in the peripheral region of the friction members and therefore at the largest friction radius. The resulting friction forces are augmented by the fact that the braced surfaces, especially the side surfaces of the stator are profiled. In this way, the friction engagement is enhanced by additional positive engagement.

Another advantageous feature of the invention is that the compensating washer that is arranged on the side of the vane rotor from which the fixing pin extends, has a locking bore into which the fixing pin can snap. By reason of the locking bore, the compensating washer is at the same time a locking disc. The locking bore in the form of a through-bore is simple to make. The flat bottom serves as a stop for the fixing pin.

Due to the fact that an O-ring seal is arranged in a groove between the inner surfaces of the cylindrical sections and the flanges that is formed by the transition radius resulting from the manufacturing process, a groove that already exists is utilized for sealing the flanges.

To summarize, it will be appreciated that, due to the oil-tight encapsulation of all the components that are pressurized by the pressure oil, the vane-type adjuster of the invention permits the use of an economic and low-noise toothed belt drive for the camshaft. The use of deep drawn components for the oil-tight housing offers additional cost advantages.

Further features of the invention will become obvious from the following description of the drawings and from the drawings themselves which give a schematic representation of one example of embodiment of the invention.

BRIEF DESCRIPTION OF THE DRAWINGS

The invention will now be described more closely with reference to an example of embodiment and the appended drawings.

DETAILED DESCRIPTION OF THE DRAWINGS

Figure 2:
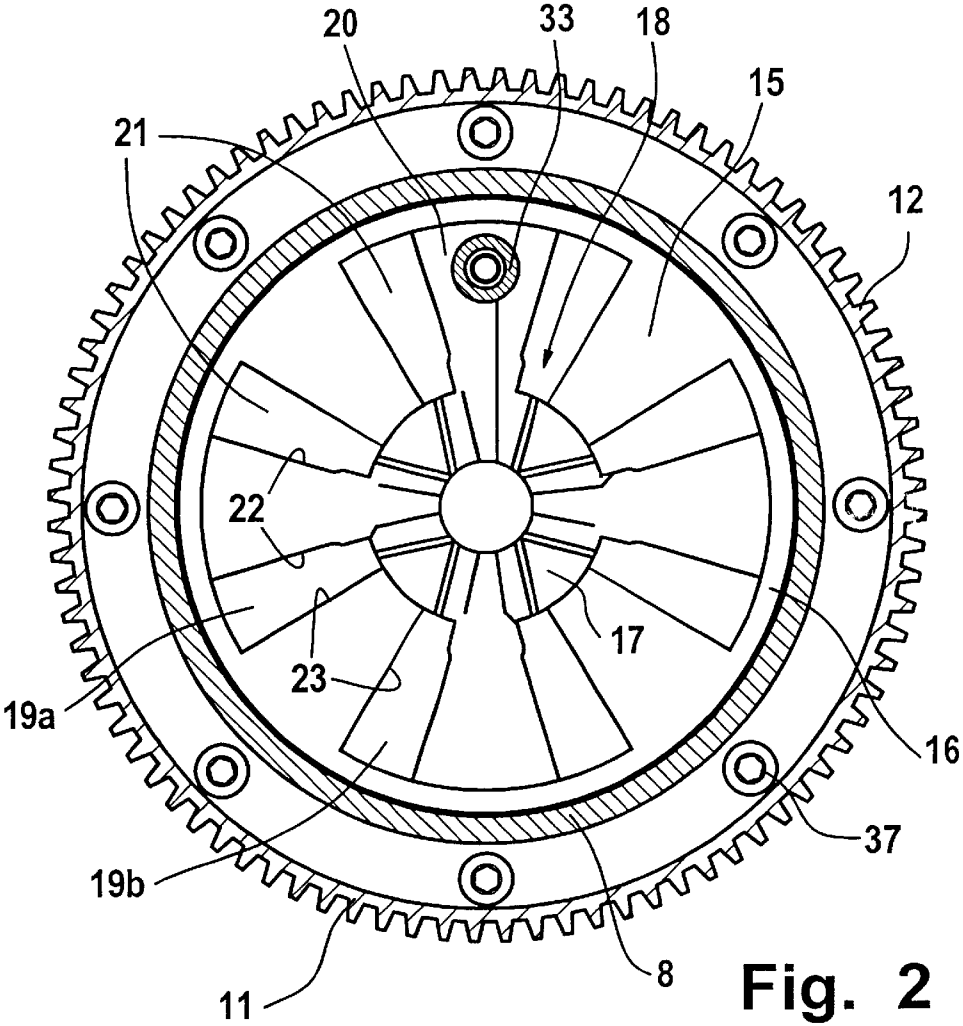
FIG. 2 is a sectional view A—A through the vane-type adjuster of FIG. 1.
Figure 1:
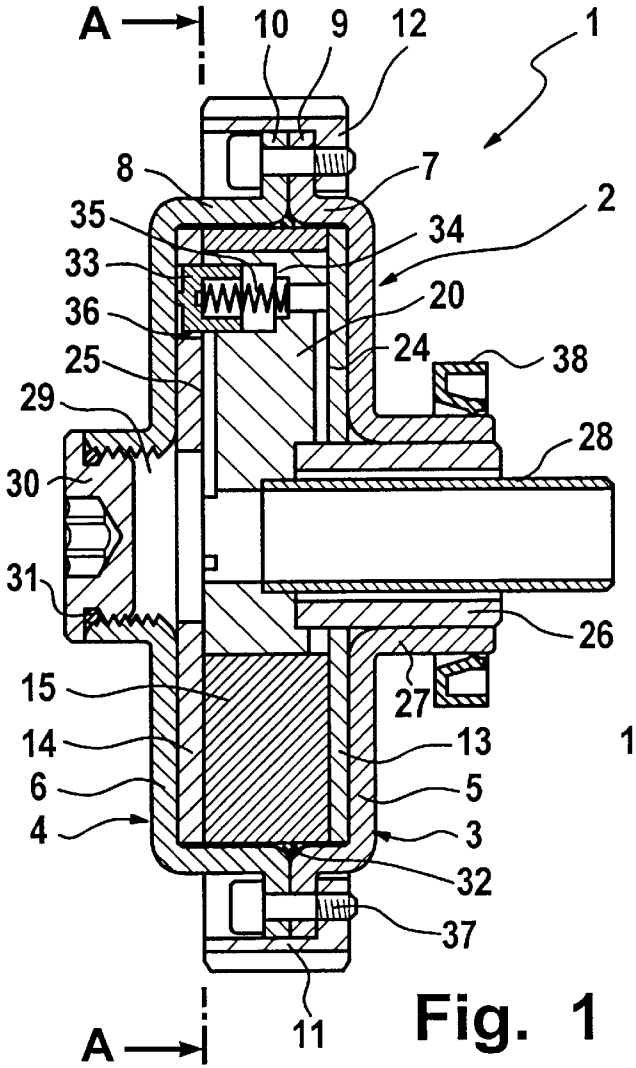
FIG. 1 is a longitudinal section through a vane-type adjuster configured according to the invention.

FIGS. 1 and 2 show a vane-type adjuster 1 that serves to adjust the angle of rotation of a camshaft relative to the crankshaft of an internal combustion engine. The gas exchange valves of the internal combustion engine are activated with the help of the camshaft. Their optimum timing varies with the engine speed. With increasing engine speed the optimum timing is offset in delay direction in the case of the inlet valves, and in the case of the outlet valves, in advance direction. In engines having separate camshafts for the inlet and outlet valves, it is possible to realize an engine-speed dependent adaptation of valve timing in a simple manner by an appropriate rotation of the camshafts. The vane-type adjuster 1 of the invention serves this purpose. It comprises a housing 2 for the oil-tight encapsulation of all components that have contact with pressure oil. The housing 2 comprises a camshaft-proximate housing part 3 and a camshaft-distal housing part 4. Each housing part 3, 4 comprises a flat bottom 5, 6 whose periphery merges into a cylindrical section 7, 8 that in its turn, merges into an outwardly extending flange 9, 10. The flanges 9, 10 are connected to a drive pinion 11 by eight equally spaced flange screws 37. These flange screws 37 are configured as fitting screws and are screwed into threaded bores of the drive pinion 11 which is configured as a toothed belt pulley. A stator 12 with a slight radial clearance to the cylindrical sections 7, 8 is inserted into the housing 2. Compensating washers 13, 14 whose diameter corresponds, with clearance, to the inner diameter of the cylindrical sections 7, 8 are disposed between the stator 12 and the flat bottoms 5, 6.

The driving torque of the camshaft is transmitted by frictional engagement from the drive pinion 11 through the flanges 9, 10, the housing parts 3, 4 and the compensating washers 13, 14 to the stator 12. The pressure bracing of the frictionally engaged members is effected by the screw force of the eight flange screws 37. Because the screw force is required to act both on the flanges 9, 10 and, parallel thereto, on the flat bottoms 5, 6, the play between the flanges 9, 10 has to be exactly defined. If this play is equal to zero before the tightening of the flange screws 37, 100% of the screw force goes into the flanges 9, 10, while the flat bottoms 5, 6 are completely devoid of force. If the play between the flanges 9, 10 before the tightening of the flange screws 37 is chosen so that it is exactly zero when the flange screws 37 have been tightened, i.e. the flanges 9, 10 just about touch each other, the entire screw force goes into the flat bottoms 5, 6 and there is no frictional engagement between the flanges 9, 10. If there is a slight play between the flanges 9, 10 before the tightening of the flange screws 37, the distribution of the screw force lies between the two extremes. By configuring the eight flange screws 37 as fitting screws, the half camshaft torque to be transmitted from the flange 9 to the other flange 10 can be transmitted exclusively by shearing force, so that the entire screw force is available for the internal frictional engagement between the bottoms 5, 6, the compensating washers 13, 14 and the stator 12.

On its periphery, the stator 12 comprises four equally spaced intermediate walls 15 that extend from an outer ring 16 up to a hub ring 17 of a vane rotor 18. The four intermediate walls 15 enclose four intermediate spaces 19, each of which is divided into two hydraulic chambers 21 by a vane 20 of the vane rotor 18. The intermediate walls 15 and the vanes 20 are conical in shape, with their non-parallel limiting surfaces 22, 23 being oriented toward the axis of the vane-type adjuster 1.

The vane rotor 18 is sealed relative to the stator 12 by seal gaps at the hub ring 17 and at the outer ring 16. The parallel limiting walls 24, 25 of the vane rotor 18 are sealed relative to the compensating washers 13, 14 in a similar manner. In the installed state of the vane-type adjuster 1, the vane rotor 18 is braced against a connecting sleeve 26 that is mounted in a cylindrical extension 27 of the camshaft-proximate housing part 3. An oil guide tube 28 arranged concentric to the connecting sleeve 26 serves to guide the flow of pressure oil. The cylindrical extension 27 and, with it, the entire vane-type adjuster 1 are protected from an escape of oil by an engine-side seal 38 acting on the outer peripheral surface of the extension 27.

A threaded opening 29 serves for the mounting of a fixing screw, not shown, with which the vane-type adjuster 1 is screwed to the camshaft. The threaded opening 29 is sealed oil-tight by a closing plug 30 comprising an O-ring seal 31. Another O-ring seal 32 serves for the pressure-oil sealing of the flanges 9, 10. It is arranged in a groove between the inner surfaces of the cylindrical sections 7, 8 and the flanges 9, 10 that is formed by the transition radius resulting from the manufacturing process.

An axially displaceable fixing pin 33 whose stepped end face can be loaded by the pressure oil is arranged in one of the vanes 20. As long as oil pressure exists, the fixing pin 33 bears against a stop 34 in the vane 20 and thus permits a pivoting of the vane rotor 18. When the oil pressure falls below a certain level (e.g. at a standstill or starting of the engine, or at a low engine speed), the fixing pin 33 is pushed into a locking bore 36 of the compensating washer 14 by a compression spring 35 that is supported on the bottom of a pocket bore in the vane 20. By this, the vane rotor 18 and the stator 12 are firmly coupled to each other thus preventing clattering noises, especially during the starting of the engine. The locking of the vane rotor 18 is effected in a position that is optimal for the starting of the engine. The locking bore 36 is configured as a through-bore. The locked fixing pin 33 bears against the camshaft-distal housing part 4 and therefore does not cause any oil leakage.

List of reference numerals

| | | | |
|---|---|---|---|
| 1 | Vane-type adjuster | 20 | Vane |
| 2 | Housing | 21 | Working chambers |

-continued

List of reference numerals

| | | | |
|---|---|---|---|
| 3 | Camshaft-proximate housing part | 22 | Non-parallel limiting surface |
| 4 | Camshaft-distal housing part | 23 | Non-parallel limiting surface |
| 5 | Flat bottom | 24 | Parallel limiting surface |
| 6 | Flat bottom | 25 | Parallel limiting surface |
| 7 | Cylindrical section | 26 | Connecting sleeve |
| 8 | Cylindrical section | 27 | Cylindrical extension |
| 9 | Flange | 28 | Oil guide tube |
| 10 | Flange | 29 | Threaded opening |
| 11 | Drive pinion | 30 | Closing plug |
| 12 | Toothed rim | 31 | O-ring seal |
| 13 | Side plate | 32 | Another O-ring seal |
| 14 | Side plate | 33 | Fixing pin |
| 15 | Intermediate wall | 34 | Stop |
| 16 | Outer ring | 35 | Compression spring |
| 17 | Hub ring | 36 | Locking bore |
| 18 | Vane rotor | 37 | Flange screw |
| 19a | Pressure chamber | 38 | Sealing ring |
| 19b | Pressure chamber | | |

What is claimed is:

1. A device for the angular adjustment of a camshaft relative to the crankshaft of an internal combustion engine including a vane-type adjuster (1) comprising:

a drive pinion (11) that is connected in driving relationship to the crankshaft of the internal combustion engine by a traction element and a toothed rim (12), in which drive pinion (11), a plurality of hydraulic working chambers (21) are formed by a hollow cylindrical outer ring (16) having a plurality of radial intermediate walls (15) and two side plates (13, 14) bearing against the outer ring, the vane-type adjuster (1) further comprising a vane rotor (18) that is rotationally fixed to the camshaft of the internal combustion engine, a plurality of vanes (20) being arranged radially on a hub ring (17) of the vane rotor (18), said vanes extending into the working chambers (21) of the drive pinion (11) and dividing each working chamber (21) into two oppositely acting hydraulic pressure chambers **(19*a*, 19*b*), an axially displaceable fixing pin (33) having a compression spring (35) being arranged in one of the vanes (20) of the vane rotor (18), which fixing pin can be displaced into a locking bore (36) in one of the side plates (13, 14) of the drive pinion (11) when pressure medium pressure falls short of a defined value, so that the vane rotor (18) and the drive pinion (11) are mechanically coupled to each other, characterized in that the hollow cylindrical outer ring (16) with the radial intermediate walls (15) and the side plates (13, 14) of the drive pinion (11) of the vane-type adjuster (1) are enclosed pressure medium-tight by an additional housing (2), the housing (2) comprises a camshaft-proximate housing part (3) and a camshaft-distal housing part (4), both these housing parts being made as sheet steel deep drawn parts that are connected to each other by a flange connection, the toothed rim (12) of the drive pinion (11) is fixed to this flange connection by which the side plates (13, 14), at least one of which is a flat, appropriately sized axial tolerance compensating washer being braced against the outer ring (16)** by force-locking.

2. A device according to claim 1, characterized in that each housing part(3,4) comprises a flat bottom (5, 6) whose periphery merges into a cylindrical section (7, 8) that continues into an outwardly extending flange (9, 10), the deep drawing depths of the two housing parts (3, 4) corresponding to the height difference between the bottom (5, 6) and the flange (9, 10) being approximately equal to each other.

3. A device according to claim 1, characterized in that the flange connection between the flanges (9, 10) of the housing parts (3, 4) and the toothed rim (12) of the drive pinion (11) is effected by flange screws (37) configured as fitting screws that are equally spaced over the periphery of the vane-type adjuster (1) and can be screwed into threaded bores of the toothed rim (12).

4. A device according to claim 2, characterized in that the surfaces of the braced elements of the vane-type adjuster (1), including the outer surfaces of the side plates (13, 14) of the drive pinion (11) and the inner surfaces of the flat bottoms (5, 6) of the housing parts are slightly profiled for increasing frictional engagement.

5. A device according to claim 1, characterized in that the side plate (14) that is arranged on that side of the vane rotor (18) from which the fixing pin (33) extends comprises the locking bore (36) for a snapping-in of the fixing pin (33), said locking bore (36) being configured as a through-bore.

6. A device according to claim 2, characterized in that, for sealing the vane-type adjuster (1), an O-ring seal (32) is arranged in a groove within the housing (2), which groove is formed between the inner surfaces of the cylindrical sections (7, 8) and the flanges (9, 10) of the housing parts (3, 4) by the transition radius resulting from the manufacturing process.

* * * * *